United States Patent [19]

Okamoto et al.

[11] 4,350,006

[45] Sep. 21, 1982

[54] SYNTHETIC FILAMENTS AND THE LIKE

[75] Inventors: Miyoshi Okamoto; Koji Watanabe, both of Ohtsu; Yasuhiko Nukushina, Kyoto; Tsuneo Aizawa, Ohtsu, all of Japan

[73] Assignee: Toray Industries, Inc., Tokyo, Japan

[21] Appl. No.: 283,382

[22] Filed: Jul. 15, 1981

Related U.S. Application Data

[63] Continuation of Ser. No. 613,604, Sep. 15, 1975, abandoned, which is a continuation of Ser. No. 43,101, Jun. 3, 1970, abandoned, which is a continuation of Ser. No. 607,302, Jan. 4, 1967, Pat. No. 3,531,368.

[30] Foreign Application Priority Data

Jan. 7, 1966 [JP] Japan ..... 41-560
Nov. 18, 1966 [JP] Japan ..... 41-75446

[51] Int. Cl.[3] ..... D02G 3/22; D02G 3/36; D01D 5/34

[52] U.S. Cl. ..... 57/250; 57/243; 57/244; 57/6; 57/7; 57/905; 264/DIG. 26; 264/176 F; 428/373; 428/394

[58] Field of Search ..... 57/200, 210, 225, 230, 57/231, 232, 243, 244, 246, 247, 248, 250, 251, 258, 3, 6, 7, 905; 264/164, 165, 166, 171, 174, 176 F, DIG. 26; 428/373, 374, 375, 378, 397, 483, 394

[56] References Cited

U.S. PATENT DOCUMENTS

| | | | |
|---|---|---|---|
| 2,610,927 | 9/1952 | Foulds | 428/264 |
| 2,932,079 | 4/1960 | Dietzsch et al. | |
| 2,987,797 | 6/1961 | Breen | 428/370 |
| 2,989,798 | 6/1961 | Bannerman | 428/373 |
| 3,099,067 | 7/1963 | Merrian et al. | |
| 3,117,362 | 1/1964 | Breen | |
| 3,117,906 | 1/1964 | Tanner | |
| 3,188,689 | 6/1965 | Breen | |
| 3,222,238 | 12/1965 | Krysiak | 428/483 |
| 3,295,552 | 1/1967 | Powell et al. | 264/171 X |
| 3,315,454 | 4/1967 | Carranza | 57/243 |
| 3,330,899 | 7/1967 | Fukushima et al. | |
| 3,382,305 | 5/1968 | Breen | 264/171 |
| 3,475,898 | 4/1967 | Magat et al. | 428/373 X |
| 3,546,063 | 5/1968 | Breen | 428/364 |

FOREIGN PATENT DOCUMENTS 1019052 2/1966 United Kingdom .

*Primary Examiner*—Donald Watkins
*Attorney, Agent, or Firm*—Austin R. Miller

[57] ABSTRACT

A synthetic filament and a yarn composed thereof wherein the filament comprises at least two different incompatible synthetic linear high polymers, one being distributed as islands in the sea of the other polymer element when seen in cross-section, each island being continuous along the axis of the filament and being characterized by their uniformity in cross-sectional dimension in any cross-section of the filament.

88 Claims, 21 Drawing Figures

SYNTHETIC FILAMENTS AND THE LIKE

This is a continuation of application Ser. No. 613,604, filed 9/15/75, now abandoned, which is a continuation of Ser. No. 43,101, filed 6/3/70, now abandoned; which is a continuation of Ser. No. 607,302, filed 1/4/67, now U.S. Pat. No. 3,531,368, granted 9/29/70.

This invention involves a synthetic filament and the like having a novel structure, a method of its manufacture and an apparatus for the manufacture of such filament. Particularly, it relates to a synthetic polymeric structure comprising one filament wherein many very fine filament parts are assembled in proximity without gaps. There very fine filament parts consist of at least two polymer elements having a different polymer composition with each element of the same polymer being continuous in the direction of the fiber axis. The invention also discloses a method for manufacturing such a synthetic polymeric filament structure and an apparatus for the manufacture of such filament. Furthermore, this invention relates to microfilaments prepared by treating these synthetic filaments along with processed articles obtained therefrom.

Many polymers are known at present. Some of them have been made into synthetic filaments by spinning, and are used widely and advantageously both at home and in the field of industry. In spite of the many merits of these conventional synthetic filaments, however, they also have defects, and are limited in their use. These defects are derived from the property limitations inherent in the polymers that make up the synthetic filament.

In the field of synthetic filaments, requests have been made to improve the filaments made from polymers when the Young's modulus is low, dyeability is inferior, dyeing fastness is inferior, shrinkage is high or low, dimensional stability is inferior, wool-like filaments are desired, the feel of the surface of the filaments is bad, the filaments cannot be made into fibrils, the properties are changeable by heat, adhesion with rubber is inferior, the fibers cannot be made very fine, an increase in crimp stability is desired, a change in the resistance to flexing is desired, a change in the density of filaments is desired, a decrease of the dimensional stability and flat spot of the tire cord made from such filaments is desired, a change in the characteristic of guts is desired, a change in the tone of a chord of a guitar, is desired, a change in the electrostatic properties of filaments is desired along with crimp elongation or elasticity and in many other possible instances.

In order to meet such a host of requirements, various attempts have been made. One of the methods would be to discover a new polymer that could be put to commercial use. Recent trends indicate however that such a method is very difficult to realize. Another method is to make a polymer blend. Because polymers have a high viscosity and molecular weight, it is difficult to mix them with ease, and they must be mixed rapidly so there is no decomposition or interreaction. If the time needed for mixing is too long, the polymers often change in quality. If too many polymers are mixed with one another, the merits of each polymer are prone to be lost. Even when it is desired to utilize the interreaction of these polymers, the reaction does not stop in a state of block formation, but tends to go as far as a random state. Furthermore, filaments obtained from a polymer blend do not have a structure wherein the dispersed polymers are continuous along the fiber axis (see FIG. 4), and for this reason, the properties such as tenacity of each polymer cannot be fully utilized.

Another method of meeting the afore-mentioned need is to make a composite filament. The composite filaments known heretofore are particularly advantageous in producing crimped yarns, and such filaments are actually commercialized in many countries of the world. While these filaments are effective in that particular field, they are not satisfactory enough to impart the various properties required of synthetic filaments.

Therefore, an object of this invention is to provide a novel synthetic filament and the like capable of advantageously exhibiting the characteristics of at least two polymers to satisfy our want and the above-mentioned needs of the industry.

This new synthetic filament advantageously exhibits the properties of at least two polymers. Filaments generally undergo repeating bending stress. However, the synthetic material of this invention undergoes the stress uniformly, and the stress by flexing is hard to concentrate on certain points. The synthetic filament made in accordance with this invention also shows a very stable behavier in the drawing and wind-up operations. Thus, the synthetic filament behaves as if it were made from one new polymer rather than at least two polymers. Furthermore, the synthetic filament of this invention has very excellent performance in dimensional stability which is one of the important performance factors for filaments. The desired Young's modulus can be imparted very easily. When the synthetic filament of this invention is used as a tire cord, the flat spot is greatly improved. Dyeability is another important factor of synthetic filaments, and the filament of this invention can be dyed uniformly. Also it is possible to process the filament of this invention into a delustered filament.

The synthetic filament having such properties comprises one filament wherein many very fine parts are assembled closely to each other without gaps. By looking at the synthetic filament of this invention from a different angle, its structural characteristic will be grasped more clearly. Namely, the cross-sectional view of the structure reveals that many islands of one polymer are dotted closely in a sea formed of another polymer or groups of a plurality of islands in contact with each other are scattered here and there. A longitudinal sectional view indicates that the polymers which make up the sea and islands are continuous without interruption in the lengthwise direction.

The polymers used in this invention may be any polymer having a fiber-forming ability. For instance, the previously well-known polymers of the polyamide, polyester, polyacryl, polyurethane and polyolefin series are usable polymers. In this invention, usually a combination of polymers of different series, such as polyamide with polyester, polyamide with polyolefin, and polyester with polyolefin are used advantageously. As a matter of course, combinations of homopolyamide with copolyamide, combinations of different copolyamides, combinations of homopolyester with copolyester, and combinations of different copolyesters can be used. Furthermore, combination of polymers having substantially the same chemical composition but having different degrees of polymerization can be used. The choice of polymer combination is often of importance, and a preferable combination is one wherein the defects of the polymers are mutually offset. When a combination of polyamide and polyester is used, the low Young's modulus of the polyamide is offset by the polyester which has a higher Young's modulus so that the Young's modulus may become uniform throughout the composite filament. Furthermore the bad dyeability of the polyester is offset by the excellent dyeability of the polyamide. In the filament of this invention, composed of very fine unit parts of polyamide and polyester, the offsetting of the defects of both polymers is homogeneous throughout the filament. Thus, this filament is free of the various defects of the conventional composite filaments or yarns obtained by the polymer blending process. A commonly used additive such as a heat-stabilizer, light-stabilizer, anti-coloring agent, antistatic agent or delusterant may be incorporated into the polymers used in this invention. In order for the synthetic filament and the like of this invention to best exhibit their advantages, it is preferable that the number of very fine parts that make up the filament should be 10 or more.

The synthetic filament of this invention is obtained by discharging a fluid of at least two polymers so as to make them adjoin each other in continuation along the lengthwise direction, assembling the discharged fluids together in a continuously and intimately adjoining fashion, and spinning this assembly through one spinning orifice. According to this method, at least two polymers are guided to the spinning orifice in a layer flow, and this is one of the characteristic features of the method of this invention. According to the method of this invention, the synthetic filament having such a complicated structure can be easily manufactured commercially, and a synthetic filament of considerably small denier can also be obtained. The spun filaments are improved in tenacity by the use of the previously known drawing method to make them into commercially acceptable filaments.

Melt-spinning, wet-spinning and dry-spinning methods are all used in this invention, but melt-spinning is particularly preferred. A greater improvement can be expected by using the method of this invention in conjunction with the conventional improved method wherein spinning conditions for the improvement of filaments are used. For instance, various non-circular orifices known heretofore can be used. Furthermore, the filaments of this invention can be subjected to various treatments after the spinning step which have been proposed heretofore for the improvement of filaments. For instance, the filaments can be crimped by means of a stuffing box, or they can be cut into staple fibers of appropriate lengths. Also, if the intended polymer alone is left in the synthetic filament and other polymers are removed by a special treatment, it is possible to obtain filaments with a very fine denier. One can thus very easily obtain monofilaments with a denier of less than 0.1. The superiority of such a fine denier filament has been hypothesized for a time, but no commercial process for manufacturing such filaments has been established. Furthermore, articles composed of very fine filaments can be obtained by interlacing the synthetic filaments by knitting or weaving or even without such treatment and then removing the polymers, leaving only the intended polymer. The microfilaments obtained are continuous along the desired length, and are very advantageous because they are continuous in the longitudinal direction along the desired length. These microfiliments compare favorably to the filaments obtained by centrifugal spinning utilizing centrifugal force or by jet spinning utilizing a jet of air which methods have been used herebefore to manufacture very fine filaments. A specific means for removing the polymers other than the intended one is to immerse the fibrous materials in a solvent which dissolves only those polymers to be removed or to melt or decompose only those polymers to be removed.

It is preferred that the method of manufacture according to this invention be practiced by means of the apparatus, which comprises: a plurality of discharging means for discharging at least two polymers simultaneously or independently, a space communicating with said discharging means adapted to receive the polymer fluids discharged from said discharging means in a layer flow, and a spinning means communicating at the one end with the said space and having orifices at other end.

For further description, the invention will be explained with reference to the accompanying drawings in which.

Figure 1:
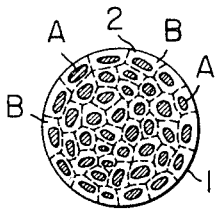
FIG. 1 is a cross-sectional view showing one example of the synthetic filament according to this invention.

The structure of the synthetic filament of this invention will be explained with reference to FIGS. 1 and 3. The synthetic filament (1) is composed of two polymers A and B. It is constructed of many units of a very fine part (2) consisting of A covered by B. With respect to the cross-section, if the portion B is considered to be the sea, the construction of this synthetic material is such that many islands of elements A are dotted uniformly in the sea. In the longitudinal section, both elements A and B are continuous without interruption along the length of the synthetic filament (1). The dotted line in FIG. 1 is an imaginary line drawn to facilitate understanding.

Figure 2:
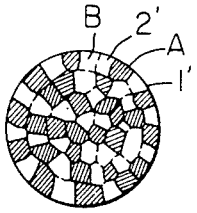
FIG. 2 is a cross-sectional view showing another example of the synthetic filament according to this invention.

In FIG. 2, the synthetic filament (1') is composed of two polymers A and B. It is constructed of many units of a very fine part (2') of A and B adhered side by side, the same being distributed uniformly throughout. With respect to the cross-section, if the portion B is considered to be the sea, the construction of this synthetic filament is such that many islands of element A are distributed uniformly in groups of a plurality of islands being in close contact with one another. In a longitudinal section, both elements A and B are continuous without interruption along the length of the synthetic filament (1'), just as in FIG. 3.

To exemplify the characteristic features of the synthetic filament of this invention, its structure will be compared with reference to drawing, to the structure of the filament obtained by the afore-mentioned conventional polymer blending process. The difference can be ascertained by a microscopic observation, and this difference is evidence of the advantageous properties of the synthetic filament made according to this invention. The difference can be clarified particularly by comparing the longitudinal sections of both filaments. The longitudinal section of the filament obtained by the conventional polymer blending method is shown in FIG. 4. It is clear from FIG. 4 taken in conjunction with FIG. 3 that the element A distributed in element B is cut intermittently along the length of filament (3). This will substantiate the fact that both filaments are different from each other not only in mechanical properties but also in dyeability. The structure of the synthetic filament of this invention is quite preferable.

Figure 5:
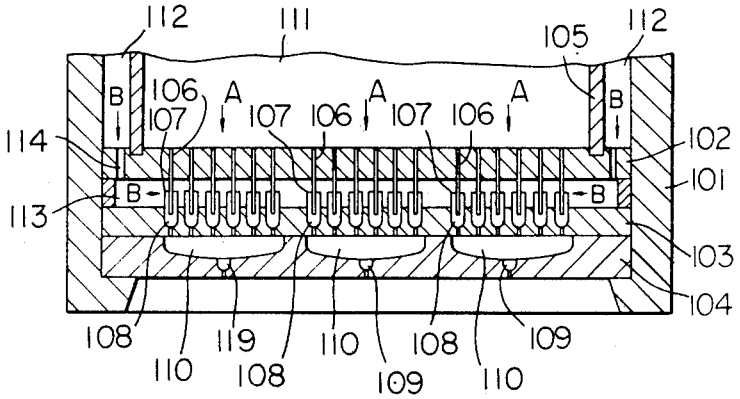
FIG. 5 is a longitudinal sectional view of one embodiment of the apparatus of this invention utilized for manufacturing the synthetic filament.

In FIG. 5, the reference numeral (101) shows a pack case having therein a composite polymer stream discharge device constructed of two discharge plates (102) and (103), and a spinneret plate (104) held tight on the under face of this discharge device. The upper part of the device is partitioned into two chambers (111) and (112) by a partition plate (105) so that polymers A and B may be fed respectively into chambers (111) and (112) without being mixed with each other. A space (113) is defined between the plates (102) and (103), and communicates with the chamber (112). Polymer B is fed into the space (113) by mean of a path (114). The composite polymer stream dischage device is a sheath-and-core type discharge device by which a composite is discharged consisting of polymer A as a core and polymer B as a sheath is. In this device, the tip portion of a narrow tube (106) fitted to the discharge plate (102) in perforation therethrough is inserted in the center of a conduit (107) fitted into a discharge orifice (108) of the discharge plate (103). Accordingly, polymer A fed through the narrow tube (106) is covered by polymer B supplied through the conduit (107) opening to the space (113), and is discharged downwardly through the discharge orifice (108). The flow-in side of a spinning orifice (109) of the spinneret plate (104) is enlarged upwardly to a greater degree, and forms a space or cell (110). This cell (110) opposes at least three discharge orifices (108) provided in the dischage plate (103). In order for the synthetic filament of this invention to exhibit its characteristics, it is preferable that one cell, that is one spinning orifice, face 3 to 10,000 discharge orifices (108). It is more preferable for one spinning orifice to face 10 or more discharge orifices.

Figure 6:
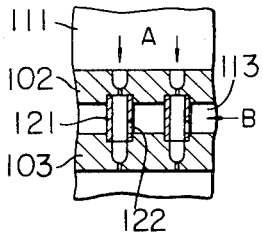
FIGS. 6 and 7 are sectional views showing other embodiments of the discharge device shown in FIG. 5.
Figure 7:
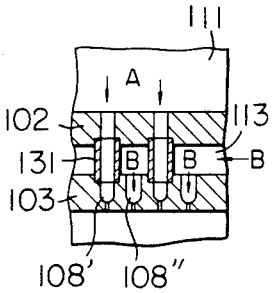

The discharge device at the rear of the spinneret may be a side-by-side type dischage device as shown in FIG. 6 or an independent type discharge device as shown in FIG. 7 in addition to the said sheath-and-core type discharge device. In the discharge device shown in FIG. 6, the discharging orifices of the upper and lower discharge plates (102) and (103) are connected to each other by means of a tube (121), and an opening (122) is provided on the side of this tube (121). Thus, polymer B comes from the space (113) into the opening (122) on the side of the tube (121) where polymer A passes through, and these two polymers are discharged through the discharge orifices in a side-by-side fashion. Another type of side-by-side discharging device may be usable if it is capable of discharging the polymers in a side-by-side fashion. In the construction of the discharge device shown in FIG. 7, some of the discharge orifices of the discharge plate (103) in the lower part are connected with the discharge orifices of the discharge plate (102) at the upper part and are opened into the chamber (111), other discharge orifices being opened into the space (113). Accordingly, polymer A alone is discharged from the orifice (108') and polymer B alone, from the orifice (108''), independently. In the case of using these types of discharging devices, it is also preferable that at least 3, preferably 10 or more, orifices of the lower part discharge plate should face each spining orifice on the spinneret plate.

When the polymers having difference properties are spun by means of the spinning apparatus shown in FIG. 5, a continuous polymer stream wherein polymer A is covered by polymer B is discharged from the discharge orifice (108) by the sheath-and-core type discharge device constructed of discharge plates (102) and (103). A number of these polymer streams are associated in one cell (110) and are spun into one filament through the spining orifice (109) of the spinneret plate (104). The cross-section of the filament so obtained indicates that the filament is composed of many very uniformly distributed units of a very fine part of polymer A covered by polymer B. In FIG. 1, dotted line drawn on the element B is an imaginary line. The cell (110) in the above apparatus is absolutely necessary to distribute and disperse the desired number of very fine sheath-and-core polymer streams within this one filament.

Figure 3:
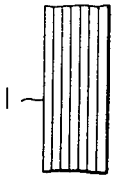
FIG. 3 is a schematic view showing a longitudinal section of the synthetic filaments shown in FIGS. 1 and 2.
Figure 4:
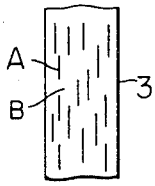
FIG. 4 is a longitudinal sectional view of the filament obtained by the conventional polymer blend process.

In FIG. 3, the polymers A and B in the very fine fibres are arranged continuously along the fiber axis without interruption. This difference distinguishes the synthetic filament of this invention from the filament obtained by the conventional as shown in FIG. 4 polymer blending proces. In the filament obtained by the conventional polymer blending process, the polymers are not continuous in the longitudinal section but are interrupted intermittently.

The filament cross-section shown in FIG. 2 is a cross-sectional view of the filament obtained by using the side-by-side type discharging device of FIG. 6 in the spinning apparatus shown in FIG. 5. Similar to the case of using the sheath-and-core type device, exceedingly fine streams of each element are distributed and dispersed very uniformly. Namely, in this case, finely discharged streams of the side-by-side type are associated into one filament. When the independent discharging device shown in FIG. 7 is used, it is also possible to prepare a filament composed of polymers arranged in a highly uniform distribution.

In the filament so obtained, each polymer is finely dispersed and is continuous along the length of the fiber axis. Therefore, the merits of each polymer are retained. For instance, the filament has the Young's modulus intermediate of its polymers. Moreover, there is less shrinkage, and, the separation of the polymers in the filament occurs less frequently than in the simple sheath-and-core type or the side-by-side type component filaments. Thus, it is possible to enlarge the area where the polymers comes into contact with one another.

In order to impart these properties completely, it is preferable that one spinning orifice on the spinneret should face at least 3 discharge orifices of the discharge device. Additionally, it is more preferable if the discharge orifices number 10 or more. If the number of polymer streams discharged from the discharge orifices to be associated with one spinneret orifice is high, the obtained filament is more homogeneous. The flexing stress is difficult to concentrate on a certain point, and is exerted uniformly throughout the filament. Such a filament exhibits a stable behavior in the operation of drawing and winding up. Namely, if the number of the polymer streams is great, the associated streams behave as if they were a filament composed of one new polymer.

The filaments obtained by the use of a sheath-and-core type discharge device, side-by-side type discharge device and an independent type discharge device are the same in that each polymer is dispersed homogeneously, but are somewhat different in a tendency toward separation. The separation is most difficult with the filaments obtained by the sheath-and-core type discharge device. This is because in the sheath-and-core filament, there is a very high probability that polymer A as the core is dispersed completely by polymer B, and that polymer B is distributed around polymer A in roughly the same thickness.

In the above-mentioned embodiments, the sheath-and-core type, this side-by-side type and the independent type discharge devices are used individually, but it is possible to combine two or three of these types of discharge devices. Filaments having a more unique effect can be obtained depending upon the manner of arrangement of these devices.

Another embodiment of the apparatus of this invention for manufacturing the synthetic filament will be explained with reference to the drawings.

In FIGS. 8, 9, 10 and 11, a housing (201) is formed of a cylinder having top and bottom openings. To the bottom open end of the housing is fitted a spinneret plate (203) having discharge orifices (202) for a polymer stream wherein two polymers are highly dispersed. A dispersing means (206) is provided on the spinneret plate (203) so as to form a space (204) for assembling branched polymer streams between the inner wall (205) of the housing (201) and the spinneret plate (203). Further, a polymer feed part (210) consisting of three blocks (207), (208) and (209) is positioned on the dispersing means (206). The polymer feed part (210) is fastened from above by a fastener (211) by the action of a screw (212). Here the dispersing means (206) corresponds to the discharge device shown in FIGS. 5, 6 and 7, and the space (204) corresponds to the cell (110) of FIG. 5.

A polymer A feed hole (213) within the first block (207) communicates with a polymer A branching hole (215) provided in the second block (208) and the third block (209) via a conical space (214) formed by the cavity perforated within the first block (207) and the second block (208). The polymer A branching hole (215) leads to the dispersing means (206). A polymer B feed hole (216) in the second block (208) of the polymer feed part (210) communicates with a polymer B branching hole (218) in the third block (209) via a conical space (217) constructed by the cavity perforated within the second and third blocks (208) and (209). The polymer B branching hole (218) leads to the dispersing means (206). Further, the polymer A feed hole (213) and the polymer B feed hole (216) are respectively engaged with a polymer A flow inlet (219) and a polymer B flow inlet (220) perforated on the lateral walls of the housing (201).

The dispersing means (206) consists of many laminated dispersing plates (224). On every other space between the laminated dispersed plates, partition plates (226) and (227) are alternately inserted. On the dispersing plate (224), the polymer A passage (221) and the polymer B passage (222) are arranged alternately in a circular fashion, and the periphery has concavities and convexities (223). The partiton plate (226) has the polymer A passage (221) and the polymer B passage (222), and the polymer A passage (221) has notches (225) which are open to the periphery of the plate. The partition plate (227) has the polymer A passage (221) and the polymer A passage (222), and the polymer B passage (222) has notches (225) which are open to the periphery of the plate.

On the upper surface of the laminated member is secured a fixed plate (228), and a fixed plate (230) equipped with a spacer (229) is held to the lower surface. A bolt (232) is inserted in a bolt hole (231) which is perforated through the centers of the plates, and the laminated member is fastened tight by nuts from both the top and the bottom surfaces. Filtering members may be provided in the conical spaces (214) and (217). The polymer A branching hole (215) and the polymer B branching hole (218) are associated with the polymer A feed hole (221) and the polymer B feed hole (222), respectively.

The function of the apparatus shown in FIG. 8 will be explained below. Polymer A and polymer B are fed into the apparatus from the polymer A feed inlet (219) and the polymer B feed inlet (220) respectively. The respective feed inlets lead to the polymer A feed hole (213) and the polymer B feed hole (216), and thence to the conical spaces (214) and (217). In these spaces, the polymer stream is branched and reaches the dispersing means (206) via the polymer A branching hole (215) and the polymer B branching hole (218) respectively.

Through the dispersing means (206), the polymer A passage (221) and the polymer B passage (222) are perforated, and the polymers A and B are flowed into the polymer passage (221) and (222), respectively. In the first partition plate (226) for th polymer A in the dispersing means (206), a part of the stream of polymer A flows out from the notch (225) of the polymer A passage (221) over the dispersing plate (224), and thence goes in the direction of the space (205). In the second partition plate (227) for the polymer B in the dispersing means (206), a part of the stream of polymer B flows out from the notch (225) of the polymer B passage (222) over the dispersing plate (224), and thence goes in the direction of the space (205).

Thus, polymers A and B streaming down the polymer passage (221) and (222) of the dispersing means (206) alternately flows from the notches (225) on the partition plates (226) and (227) onto each dispersing plate, and form dispersed stream sources. These dispersed polymer stream sources are dispersed. Further by the action of the concavities and convexities (223) on the periphery of the dispersing plates (224) and flow into the space (205).

By setting the dispersing plates differently from each other at the placing of concavities and convexities, the streams of each polymer are associated while retaining their own streams as they flow down the space (205), and reach the upper surface of the spinneret plate (203). Namely, dispersed streams which are new streams formed as they flow down through the space (205) are dischaged from each spinning orifice (202) and spun into filaments. Examining the structure of synthetic filament (1), one will find that polymers A and B are mutually dispersed, and are arranged in a long continuous fashion along the fiber axis.

In the above-explained embodiment, explanation has been made of the dispersing plate (224) having concavities and convexities (223), but the dispersing plate (224) may do without the concavities and convexities (223). In order to obtain preferable dispersed streams, it is better to have the concavities and convexities on the periphery of the dispersing plate (224). For better polymer dispersion, it is preferably that such a material as a net, porous material and a jaggy linear material be provided on the end of the space (205) or the distributing plate (224) to further divide, associate and re-divide the polymers flowing out along the dispersing plate.

Figure 12:
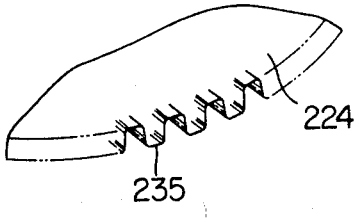
FIGS. 12 and 13 are perspective views in part showing other embodiments of the dispersing plate of the apparatus shown in FIG. 8.
Figure 14:
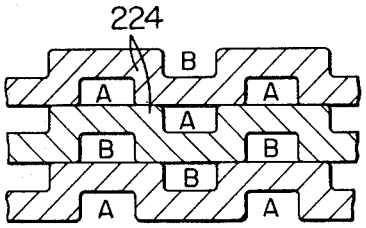
FIG. 14 shows the lamination of the dispersing plates of FIG. 12.

It is also effective to make the peripheral portion of the dispersing plate (224) wavy as shown in part in FIG. 12 by the reference numeral (235). A part of the side of the dispersing means constructed by laminating the dispersing plates and partition plates in the above-mentioned manner is shown in FIG. 14. Polymer A which flows from the end of the dispersing plate into the space (205) is associated with polymer B which flows from the end of the dispersing plate immediately thereunder into the space (205). Polymer A or polymer B is dispersed into polymer B or polymer A, and the so dispersed polymers flow down through the space (205).

Figure 13:
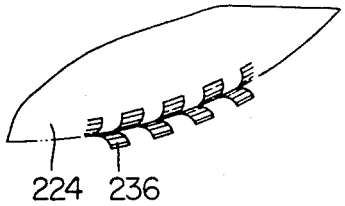

FIG. 13 shows a dispersing plate (224) whose periphery is of a bristle type wherein bristles are turned alternately up and down. This type of dispersing plate also performs dispersion effectively.

Figure 15:
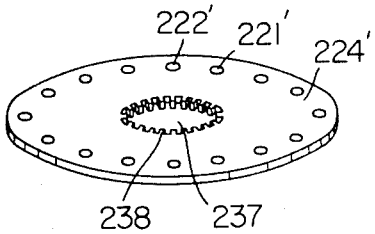
FIGS. 15, 16 and 17 are perspective views showing the dispersing and partition plates and used in another embodiment of the apparatus shown in FIG. 8.
Figure 16:
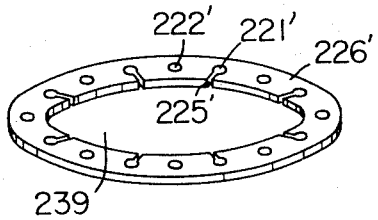
Figure 17:
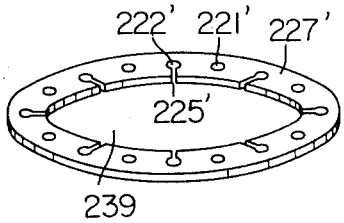
Figure 18:
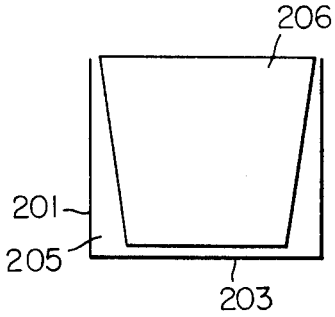
FIG. 18 is a schematic sectional view showing another embodiment of the apparatus shown in FIG. 8.

Now, another embodiment of the apparatus of this invention will be explained briefly with special reference to its dispersing device. FIGS. 15, 16 and 17 show the dispersing plates and partition plates to be used in this embodiment. The great difference between this embodiment and the afore-mentioned embodiment is that a space to form dispersed streams is sitauted in the center of the apparatus. The dispersing plate (224') has polymer A passage (221') and polymer B passage (222') on the periphery, and a hole (237) to form a space in the center. Concavities and convexities (238) are formed on the inner periphery of the hole (237). A partition plate (226') for polymer A as shown in FIG. 16 possesses polymer A and B passages (221') and (222'), the passage (221') with notches (225') being opened into the hole (239) in the center. Further, the partition plate (227') for polymer B is provided with passages (221') and (222') for polymers A and B, the passages (222') with notches (225') being opened into the hole (239) in the center. These three kinds of plates are lamimated in many layers in the order of dispersing plate (224'), partition plate (226'), dispersing plate (224') and partition plate (227') to form a dispersing means. The hole (237) has a diameter smaller than the hole (239), and they are arranged concentrically. The passages (221') and (222') are each aligned in a line. The function and advantages of this embodiment are the same as those of the previously explained embodiment.

Figure 8:
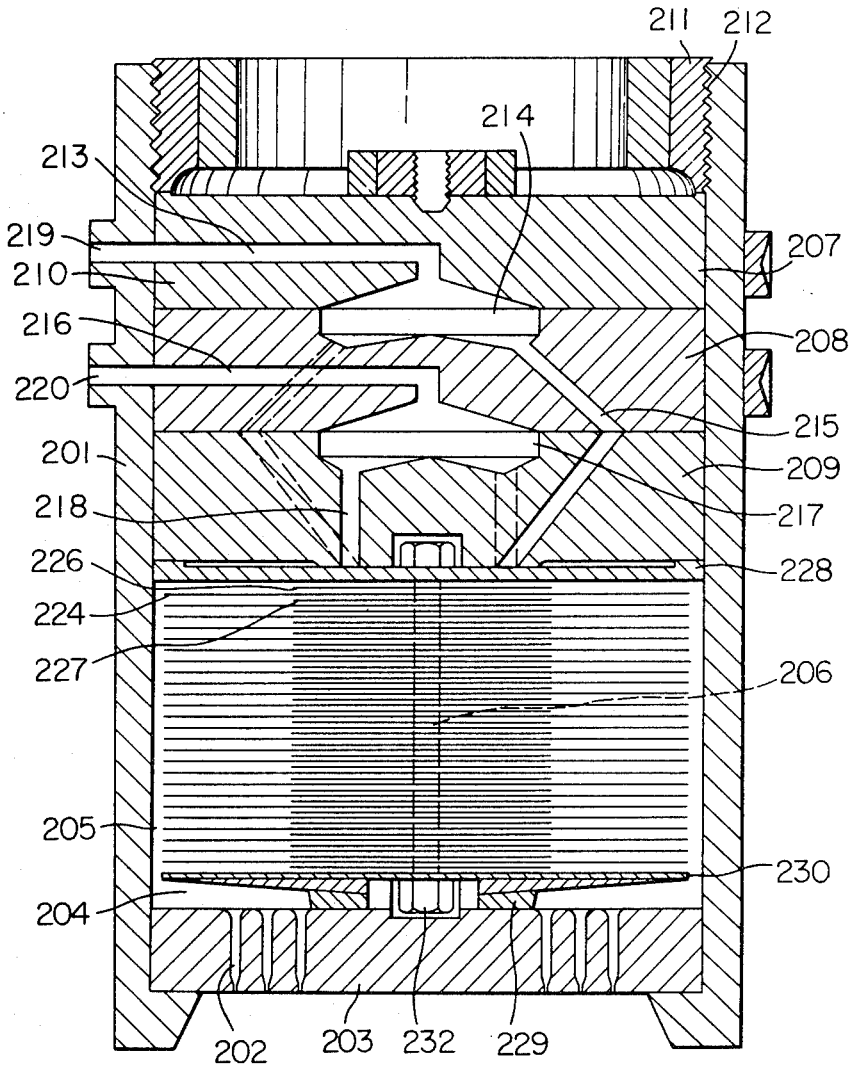
FIG. 8 is a longitudinal sectional view showing another embodiment of the apparatus of this invention for manufacturing the synthetic filament.
Figure 9:
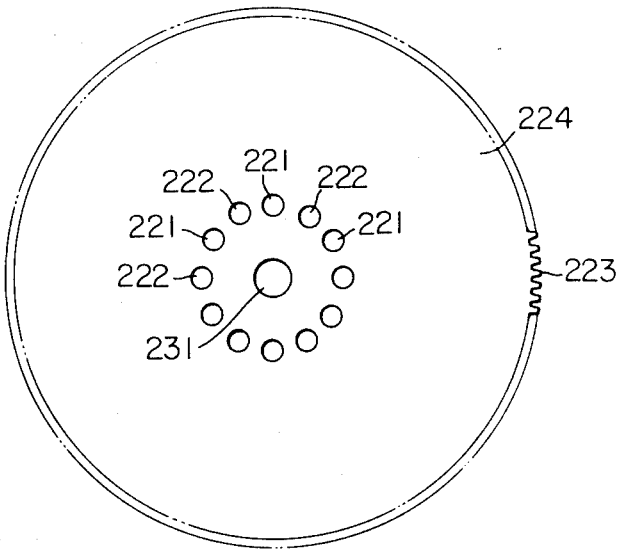
FIGS. 9, 10 and 11 are plan views showing a dispersing plate and partition plates of the apparatus shown in FIG. 8.
Figure 10:
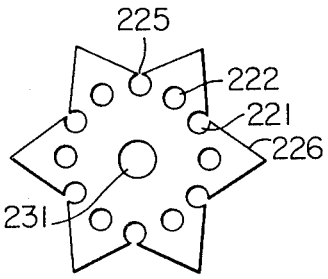
Figure 11:
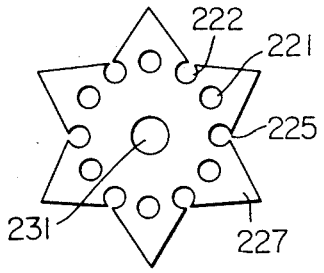
Figure 19:
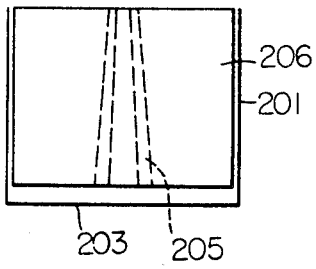
FIG. 19 is a schematic view showing another spinning apparatus wherein the dispersing plate and partition plates shown in FIGS. 15, 16 and 17 are used.

The shape of the space (205) formed between the dispersing means (206) and the housing (201) may be as shown in FIG. 8. It is also possible to change the shape of the dispersing plates so that the dispersing means (206) may be of inverse conical shape, and to form the space (205) to become progressively broader downwards. Or it is also permissible to form the space (205) by deforming the housing (201). Furthermore, as shown in FIG. 19, it is possible to shape the space (205) in a conical form by using the dispersing plate (224') shown in FIG. 15 and laminating the dispersing plates (224') whose holes (237) are concentrically larger towards the bottom.

The number of dispersing plates to be laminated may be selected according to the desired object such as the degree of dispersing, but to elevate the operational efficiency, the number should preferably be increased within the range where no deviating stream occurs. For instance, the number may be 50 or 5,000.

The apparatus comprises a plurality of dispersing plates, a space for collecting the polymers flowing from the dispersing plates and a device for discharging the dispersed polymer streams flowing in the space. By using this apparatus, therefore, at least two polymers, when made into filaments, are such that one polymer is dispersed in the other polymer in the filament section, and it is possible to stably and efficiently produce filaments having a continuous structure along the fiber axis. In the foregoing, no explanation for the production of synthetic filament from two polymers has been given. However, the production of synthetic filaments of this invention from three or more polymers ca be achieved easily by using the apparatus of this invention which is constructed as mentioned above.

Figure 20:
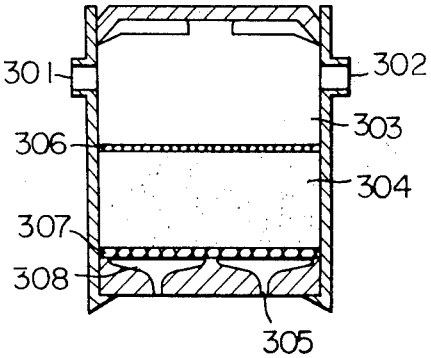
FIG. 20 is a longitudinal sectional view showing still another embodiment of the apparatus of this invention for manufacturing the synthetic filament.
Figure 21:
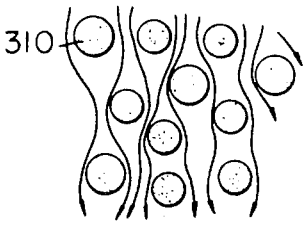
FIG. 21 is a view showing the state of the layer flow being dispersed and then associated.

Another embodiment of the apparatus shown in FIG. 20 is for the purpose of more effectively dispersing the layer stream. To achieve this end, one or more sand layers, glass balls, metal net filters, porous plates and porous metals are arranged in layers, and polymers are passed through them. If necessity arises, the particles size and net mesh of these materials can be changed as desired. The thickness of the layers or the pressure to be exerted on the whole layers can be adjusted optionally. The streams of polymers A and B are guided independently into the upper part (303) of the discharge device through conduits (301) and (302), respectively. This part (303) will not be detailed here as it corresponds to the discharge device and dispersing means shown in FIGS. 5 and 8, respectively. Both polymers are associated and divided in the part (303) and turn into a layer stream where these polymers are laminated in the A, B, A, B . . . order. The layer stream is introduced into a dispersing portion (304) capable of dispersing the said layer stream. The dispersing portion (304) is a porous layer consisting of such materials as sand, glass balls, metal nets, filters porous plates or porous metals either alone or in combination which have a size predetermined by the thickness of the layer stream. Thus, the layer stream is divided and associated at random while flowing among particles (310). As shown in FIG. 21, the dispersion and mixing of a highly viscous stream takes place to a greater degree. Here the polymer stream, is not cut off as it flows nor is the mixing done at random.

During or after the passage of the polymer streams through the dispersing part (304), each layer of the layer stream continuous in the widthwise direction is cut off at places, and another element is dispersed into the matrix element in the shape similar to that shown in FIG. 1. Each of the dispersed elements independently forms an island A. This island A may sometimes be coalesced with an adjoining island. The polymer which forms each island is continuous along the longitudinal direction (see FIG. 3). The polymer streams dispersed in the sea-and-island form after passage of the dispersing portion (304) are passed through a lower part filter (307), associated in a cell (308), stabilized, and spun through a spinning orifice (305) while assembling the dispersed streams. The reference numeral (306) is a filter to support the sand (310) together with the filter (307).

The thus obtained filament has a cross section where islands composed of polymer A are dotted on the sea formed of polymer B. This filament 1, when drawn, can be the size of about 1 denier. Therefore, a single filament of polymer A in the very fine part of filament 1 must be smaller in diameter. If polyethylene terephthalate and nylon 6 are used respectively as polymer A and polymer B, made into a composite filment in the manner explained above, and then put into formic acid, the nylon 6 is dissolved but the polyethylene terephthalate, which is insoluble in formic acid, remains as a plurality of monofilaments of 0.047 denier. Thus, according to this invention, a very fine synthetic monofilament can be obtained. This is surprising in view of the fact that heretofore continuous very fine filaments with less than 0.1 denier have not been prepared.

The filaments 1 as above mentioned are woven or knitted into fabrics or made into a web fo use in non-woven fabrics. If such a fabric or web is subjected to a suitable solvent to dissolve polymer B, only polymer A, insoluble in said solvent, remains in the fabric or web. Thus, it has become possible to prepared a particular fabric formed of very fine denier filaments.

The following Examples are given only to illustrate this invention, and should not be construed as limitation.

EXAMPLE I

In this example, polyethylene terephthalate and nylon 6 are used as the polymers to make up a very fine filament part.

The said polyethylene terephthalate has an intrinsic viscosity of 0.66 measured in ortho-chlorophenol at 25° C., and the nylon 6 has a relative viscosity of 2.35 measured at 25° C. with respect to a solution of 1% of the nylon in a 98% sulfuric acid. Both polymers have 0.5% of $TiO_2$ incorporated therein.

The apparatus used is the type shown in FIG. 5 which has the discharge device shown in FIG. 7. The diameter of the discharge orifices (108') and (108'') are 0.2 mm, and there are provided 1000 such orifices. On the other hand, the diameter of the spinning orifice (109) in the spinning device is 0.3 mm, and there are provided 10 such orifices. The amounts of polyethylene terephthalate and nylon 6 discharged from th discharge orifices are 11 g/min. and 25 g/min., respectively, and the temperature of each polymer is 285° C. The filaments spun from the spinning orifices are passed through a cooling chimney in the conventional manner. The air fed into the chimney is 22° C., and the speed of the air current through the chimney is 40 m/min. The filaments are then taken up at a rate of 1000 m/min. In the subsequent step, drawing is carried out with the use of pin and hot plate. The pin has a diameter of 65 mm, and its surface is maintained at 90° C. The hot plate has a length of 20 cm, and its surface is maintained at 160° C. The filaments are drawn to 4.1 times the original length at a rate of 250 m/min. The drawn filaments are wound up with a winding tension of 0.29 g/denier.

The drawn yarn consists of 10 filaments, each of which is of 8 denier. In one filament, 50 islands (A) formed of polyethylene terephthalate are dispersed uniformly in the sea (B) made of nylon 6, as shown in FIG. 1. The islands and sea are continuous without interruption in the longitudinal direction of the filament.

The so obtained filaments have a tenacity of 5.9 g/denier, an elongation of 30.2%, a Young's modulus of 45 g/denier, and a shrinkage in boiling water of 7.5%. Incidentally, nylon 6 has a Young's modulus of 30 g/denier, and polyethylene terephthalate 80 g/denier.

To confirm the denier of one island composed of polyethylene terephthalate, the filament is immersed in formic acid and the nylon 6 portion is dissolved. Thus, a plurality of microfilaments consisting of polyethylene terephthalate are obtained. These monofilaments are of 0.058 denier, and have a tenacity of 5.6 g/denier and an elongation of 12%.

EXAMPLE II

In this example, polyethylene terephthalate and nylon 6 are used as the polymers to compose a very fine filament part.

The polyethylene terephthalate has an intrinic viscosity of 0.74 measured in ortho-chlorophenol at 25° C., and the nylon 6 has a relative viscosity of 2.35 measured at 25° C. with respect to a solution of 1% of nylon in a 98% of sulfuric acid. Both polymers have 0.5% $TiO_2$ incorporated therein.

The apparatus used is the type shown in FIG. 5 with the discharge device as shown in FIG. 6.

The diameter of the discharge orifices is 0.25 mm, and there are provided 790 such orifices. On the other hand, the spinning orifice (109) of the spinning device has a diameter of 0.3 mm, and there are provided 10 such orifices. The amounts of the polyethylene terephthalate and nylon 6 discharged from the discharge orifices are 4.4 g/min. and 6.6 g/min., respectively. The polymer temperature is 290° C. for the polyethylene terephthalate and 280° C. for the nylon 6. The filaments spun from the spinning orifices are passed through a cooling chimney in the conventional manner. The air fed into the chimney has a temperature of 22° C., and the speed of the air flowing through the chimney is 35 m/min. The filament take-up speed is 1000 m/min. In the subsequent step, drawing is carried out with the use of a pin and a hot plate. The pin has a diameter of 35 mm and its surface is maintained at 90° C. The hot plate is 20 cm long, and maintained at its surface at a temperature of 160° C. The filaments are drawn to 3.4 times the original length at a rate of 300 m/min. The drawn filaments are wound up with a winding tension of 0.20 g/denier.

The drawn yarn consists of 10 filaments, each of which is of 3 denier. In one filament, 79 islands (A) composed of polyethylene terephthalate are dispersed uniformly in the sea (B) formed of nylon 6, as shown in FIG. 1. The islands and sea are continuous without interruption in the longitudinal direction.

To confirm the denier of one island of polyethylene terephthalate, the filament is immersed in formic acid and the nylon 6 portion is dissolved and removed. Thus, 79 microfilaments of polyethylene terephthalate are obtained. These microfilaments are of 0.015 denier and have a tenacity of 5.8 g/denier.

EXAMPLE III

In this example, polypropylene and polyethylene terephthalate are used as the polymers to make up a very fine filament part.

The polypropylene has an intrinsic viscosity of 1.38 measured in tetralin at 135° C., and the polyethylene terephthalate has an intrinsic viscosity of 0.60 measred in ortho-chlorophenol at 25° C. Both polymers have 0.5% of $TiO_2$ incorporated therein.

The apparatus used in the type shown in FIG. 5. The discharge orifice has a diameter of 0.25 mm, and there are provided 500 such orifices. On the other hand, the diameter of the spinning orifice (109) in the spinning device is 0.3 mm, and there are provided 20 such orifices. The amounts of polypropylene and polyethylene terephthalate discharged from the discharge orifices are 4.7 g/min. and 18.9 g/min., respectively. Each polymer has a temperature of 290° C. The filaments spun from the spinning orifices are passed through a cooling chimney in the conventional manner. The air fed into the chimney has a temperature of 22° C., and the speed of the air flowing through the chimney is 30 m/min. The filament take-up speed is 800 m/min. In the subsequent step, drawing is carried out with the use of a pin and a hot plate. The pin has a diameter of 65 mm and its surface is maintained at 95° C. The hot plate is 30 cm long and its surface is maintained at 150° C. The filaments are drawn to 3.8 times the original length at a rate of 250 m/min. The drawn filaments are wound up with a winding tension of 0.2 g/denier.

The drawn yarn consists of 20 filaments each of which is of 3.5 denier. In one filament, 25 islands (A) of polypropylene are dispersed uniformly in the sea (B) formed of polyethylene terephthalate, as shown in FIG. 1. The islands and sea are continuous in the longitudinal direction of the filament. The so obtained filament has a tenacity of 4.7 g/denier, an elongation of 32%, and a Young's modulus of 68 g/denier.

To confirm the denier of one island of polypropylene, the filament is treated with an aqueous alkali solution and the polyethylene terephthalate is dissolved and removed. Thus, there are obtained 500 multifilaments of polypropylene with the monofilament being of 0.028 denier.

EXAMPLE IV

Two polyethylene terephthalates having intrinsic viscosities of 0.68 and 0.50 when measured in ortho-chlorophenol at 25° C. are used as the polymers to make up a very fine filament part. The former polyethylene terephthalate contains 0.05% of $TiO_2$ and 0.5% of carbon black, and the latter polyethylene terephthalate has a high brilliancy.

The apparatus used in the type shown in FIG. 5 with the discharge device shown in FIG. 7. The diameters of the discharge orifices (108') and (108'') are 0.2 mm, and there are provided 1000 such orifices. On the other hand, the diameter of the spinning orifice (109) of the spinning device is 0.3 mm, and there are provided 16 such orifices. The amounts of the former polyethylene terephthalate and the latter polyethylene terephthalate discharged through the discharge orifices are 7.0 g/min. and 10.6 g/min., respectively. The temperature of each polymer is 285° C. The filaments spun from the spinning orifices are passed through a cooling chimney in the conventional manner. The air fed into the chimney has a temperature of 20° C., and its speed flowing through the chimney is 35 m/min. The filaments are taken up at a rate of 1000 m/min. In the subsequent step, drawing is carried out with the use of a pin and a hot plate. The pin has a diameter of 25 mm, and its surface is maintained at 90° C. The hot plate is 25 cm long, and the surface temperature is held at 153° C. The filaments are drawn to 3.4 times the original length at a rate of 300 m/min. The drawn filaments are wound up.

The drawn yarn consists of 16 filaments each of which is of 3.0 denier. The polyethylene terephthalate containing carbon black is uniformly in the brilliancy polyethylene terephthalate having a brilliancy when the filament is viewed in its cross section. These polymers are in long and thin continuation in the longitudinal section. The filament is beautiful with deep black and brilliancy, has a tenacity of 4.3 g/denier, an elongation of 34%, and a Young's modulus of 78 g/denier.

EXAMPLE V

In this example, polyacrylonitrile (a copolymer of methyl acrylate with sodium acrysulfonate) and cellulose acetate are used as the polymers to make up a very fine filament part.

The polyacrylonitrile has an intrinsic viscosity of 1.45 measured at 25° C. in a 25% dimethyl sulfoxide, and the cellulose acetate has an intrinsic viscosity of 1.70 measured at 25° C. in a 25% dimethyl sulfoxide.

The apparatus used is the type shown in FIG. 5 with the discharge device as shown in FIG. 6. The discharge orifice has a diameter of 0.06 mm, and there are provided 2000 such orifices. On the other hand, the diameter of the spinning orifice (109) in the spinning device is 0.08 mm, and there are 40 such spinning orifices. The amounts of polyacrylonitrile and cellulose acetate discharged from the discharged orifices are 1.6 g/min. and 0.4 g/min., respectively. The temperature of each polymer is 25° C.

The spin filaments are passed initially through a bath consisting of 50% of dimethyl sulfoxide and 50% of water and maintained at 25° C. at a rate of 9 m/min. The spun filaments are then passed through a second bath comprising 30% of dimethyl sulfoxide and maintained at 100° C. at a rate of 45 m/min. Finally the spun filaments are passed through a third bath comprising 15% dimethyl sulfoxide maintained at 60° C. at a rate of 45 m/min. After a wet heat treatment, the so treated filaments are dried.

The thus obtained filamens consist of 40 monofilaments each having a unique feeling and a denier of 2.5.

What is claimed is:

1. A bundle of ultrafine filaments composed of a fiber-forming polymer which is characterized in that said bundle comprises at least 10 substantially parallel ultrafine filaments each of which is continuous along the longitudinal axes of said bundle and has a denier of less than 0.1.

2. A bundle of ultrafine filaments according to claim 1, wherein each of said ultrafine filaments has a substantially rounded cross section along its entire longitudinal axis.

3. The bundle of ultrafine filaments according to claim 1, wherein said ultrafine filaments have substantially the same denier.

4. The bundle of ultrafine filaments according to claim 2, wherein said ultrafine filaments have substantially the same denier.

5. The bundle of ultrafine filaments according to claim 1, wherein the fiber-forming polymer molecules are oriented in the longitudinal direction in each of said ultrafine filaments.

6. The bundle of ultrafine filaments according to claim 1, wherein the number of said ultrafine filaments is 10 to 10,000.

7. The bundle of ultrafine filaments according to claim 1, wherein said fiber-forming polymer is polyethylene terephthalate.

8. A process for the production of a bundle of ultrafine filaments each having a denier of less than 0.1 composed of a fiber-forming polymer, which comprises discharging two molten fiber-formimg polymers having different compositions as at least one group, each said group consisting of at least 10 separate streams, each stream being in a sheath-and-core configuration wherein one polymer is covered by the other, combining said stream groups and spinning them together to form a continuous as-spun filament, and dissolving the sheath polymer of the filament with a solvent which dissolves the sheath polymer but not the core polymer.

9. The process according to claim 8, wherein said as-spun filament is drawn without breaking the filament, and thereafter, the sheath polymer of the filament is dissolved with the solvent.

10. In a yarn consisting of a plurality of composite filaments wherein each filament includes at least two different incompatible synthetic linear high polymers, and wherein one polymer functions as a matrix and said other polymer consists of a multiplicity of continuous ultrafine cores distributed substantially uniformly throughout the longitudinal body of the matrix, and wherein each core is characterized by its uniformity in a cross-sectional dimension, and the cross-sectional dimensions from core to core being of the same order of magnitude, the improvement wherein:

a. said cores are substantially parallel to one another when said filament is viewed in longitudinal section;

b. said cores are substantially rounded and substantially surrounded by other cores when viewed in transverse cross section; and c. each filament having a constant number of cores throughout its length wherein the number of said cores is at least 10 and not greater than 10,000.

11. A yarn, as recited in claim 10, wherein said cores are spaced apart from each other, and wherein each core is completely adjacently enclosed by said matrix.

12. A yarn, as recited in claim 11, wherein said matrix is distributed around each core by substantially the same thickness as measured from core center to core center.

13. A yarn, as recited in claim 10, wherein the filament is substantially homogeneous, and any flexing stress is exerted substantially uniformly throughout the filament regardless of the direction in which the stress is exerted.

14. The yarn as recited in claim 10, wherein the denier of each of said cores is less than 0.1.

15. A yarn as recited in claim 10, wherein the ratio of cores to matrix is at least 11:25.

16. A yarn as recited in claim 10, wherein the filament includes a group constructed of an assembly of 10 to 10,000 conjugated filamentary units in which each core island is covered by the matrix, and wherein the cores are close to each other so that they contact each other without any gap therebetween, each core contacting its neighor along a line.

17. A yarn as recited in claim 10 wherein said core includes a polyamide polymer.

18. A yarn as recited in claim 10, wherein said cores include a polyester polymer.

19. A yarn as recited in claim 10, wherein said cores include a polyacrylic polymer.

20. A yarn as recited in claim 10, wherein said cores include a polyurethane polymer.

21. A yarn as recited in claim 10, wherein said cores include a polyolefin polymer.

22. A yarn as recited in claim 10, wherein said cores include a copolyamide polymer.

23. A yarn as recited in claim 10, wherein said cores include a copolyester polymer.

24. Improved synthetic conjugate filaments wherein each filament comprises at least two different polymer elements, one of the polymer elements being, in longitudinal view, uniformly continuous as substantially parallel lines of many ultra-fine roundish filaments without branch, interbond and short fibril in the other polymer element, and being, in each cross section view, distributed substantially over the cross section as fine islands in the sea of said latter polymer elements without overlapped ribbon layers and convolution layers, characterized in that:

(1) when seen in any cross-sectional view of the filaments, a. a number of islands are dotted uniformly all over the sea and in both the center and periphery parts of the filaments;

b. the dotted islands of the inner part of the filaments are surrounded by the other islands of the outer part of the filament, and c. the number of the islands is within the range of from 10 to 10,000.

25. In a yarn consisting of a plurality of composite filaments wherein each filament includes at least two different incompatible synthetic linear high polymers, and wherein one polymer functions as matrix and said other polymer consists of a multiplicity of continuous ultra-fine cores distributed substantially uniformly throughout the longitudinal body of the matrix, and wherein each core is characterized by its uniformity in cross sectional dimension, and the cross sectional dimensions from core to core being of the same order of magnitude, the improvement wherein:

a. said cores are substantially parallel to one another when said filament is viewed in longitudinal section;

b. said cores are substantially rounded and substantially surrounded by other cores when viewed in transverse cross section; and c. each filament has a constant number of cores throughout its length wherein the number of said cores is at least ten and not greater than 10,000, and wherein a plurality of said cores are in contact with other cores and with said matrix.

26. A composite filament comprising at least two different incompatible synthetic linear high polymers, wherein one polymer functions as a matrix and said other polymer consists of a plurality of continuous ultra-fine cores distributed substantially uniformly throughout the longitudinal body of the matrix, and wherein each core is characterized by its uniformity in cross sectional dimension, and the cross sectional dimensions from core to core being of the same order of magnitude, the improvement wherein:

a. said cores are substantially parallel to one another when said filament is viewed in longitudinal section;

b. said filament having a constant number of cores throughout its length, c. and wherein some of said cores are in contact with other cores and wherein the remaining cores are completely adjacently surrounded by said matrix.

27. Composite filament as recited in claim 26, wherein at least 10 cores are provided.

28. Composite filament as recited in claim 26, wherein the denier of each of said cores is less than 0.1.

29. Composite filament as recited in claim 26, wherein said cores comprise a polyester polymer.

30. Composite filament as recited in claim 26, wherein said matrix comprises a polyamide polymer.

31. Composite filament as recited in claim 26, wherein said cores are substantially rounded when viewed in transverse cross section.

32. In a yarn consisting of a plurality of composite filaments wherein each filament includes at least two different incompatible synthetic linear high polymers, and wherein one polymer functions as a matrix and said other polymer consists of a multiplicity of continuous ultra fine cores distributed substantially uniformly throughout the longitudinal body of the matrix, and wherein each core is characterized by its uniformity in cross sectional dimension, and the cross sectional dimensions from core to core being of the same order of magnitude, the improvement wherein each of said filaments has the same number of cores.

33. A yarn as recited in claim 32, wherein said cores substantially parallel to one another when said filament is viewed in longitudinal section.

34. A yarn as recited in claim 32, wherein said cores all have substantially the same denier.

35. A yarn as recited in claim 32, wherein the number of cores in each of said filaments is less than 10.

36. A yarn as recited in claim 32, wherein the number of cores in each of said filaments is 10 to 10,000.

37. A yarn as recited in claim 32, wherein said cores are spaced apart from each other and wherein each said core is completely adjacently enclosed by said matrix.

38. A yarn as recited in claim 32, wherein a plurality of said cores are in contact with other cores and with said matrix.

39. A yarn as recited in claim 32, wherein each said filament is substantially homogenous, and any flexing stress is exerted substantially uniformly throughout the filament regardless of the direction in which the stress is exerted.

40. A yarn as recited in claim 32, wherein the ratio of cores to matrix in each of said filaments is at least 11:25.

41. A yarn as recited in claim 32, wherein said cores comprise a polyamide polymer.

42. A yarn as recited in claim 32, wherein said cores comprise a polyester polymer.

43. A yarn as recited in claim 32, wherein said cores comprise a polyacrylic polymer.

44. A yarn as recited in claim 32, wherein said cores comprise a polyurethane polymer.

45. A yarn as recited in claim 32, wherein said cores comprise a polyolefin fiber.

46. A yarn as recited in claim 32, wherein said cores comprise a copolyamide polymer.

47. A yarn as recited in claim 32, wherein said cores comprise a copolyester polymer.

48. A yarn as recited in claim 32, wherein said matrix comprises a polyamide polymer.

49. A yarn as recited in claim 32, wherein each said filament is free of irregularly shaped cores at the periphery of said filament.

50. A yarn as recited in claim 32, further comprising distribution of said cores on a plurality of concentric circles as seen in any transverse cross sectional view of said filament.

51. In a yarn consisting of a plurality of composite filaments wherein each filament includes at least two different incompatible synthetic linear high polymers, and wherein one polymer functions as a matrix said other polyer consists of a multiplicity of continuous ultra fine cores distributed substantially uniformly throughout the longitudinal body of the matrix, and wherein each core is characterized by its uniformity in cross sectional dimension, and the cross sectional dimensions from core to core being of the same order of magnitude, the improvement wherein each said filament is free of irregularly shaped cores at the periphery of said filament.

52. A yarn as recited in claim 51, wherein said cores are substantially parallel to one another when said filament is viewed in longitudinal section.

53. A yarn as recited in claim 51, wherein said cores all have substantially the same denier.

54. A yarn as recited in claim 51, wherein the number of said cores in each filament is less than 10.

55. A yarn as recited in claim 51, wherein the number of said cores in each filament is 10 to 10,000.

56. A yarn as recited in claim 51, wherein said cores are spaced apart from each other and wherein each said core is completely adjacently enclosed by said matrix.

57. A yarn as recited in claim 51, wherein a plurality of said cores are in contact with other cores and also with said matrix.

58. A yarn as recited in claim 51, wherein each said filament is substantially homogenous, and said flexing stress is exerted substantially uniformly throughout the filament regardless of the direction in which the stress is exerted.

59. A yarn as recited in claim 51, wherein the ratio of cores to matrix is at least 11:25.

60. A yarn as recited in claim 51, wherein said cores comprise a polyamide polymer.

61. A yarn as recited in claim 51, wherein said cores comprise a polyamide polymer.

62. A yarn as recited in claim 51, wherein said cores comprise a polyacrylic polymer.

63. A yarn as recited in claim 51, wherein said cores comprise a polyurethane polymer.

64. A yarn as recited in claim 51, wherein said cores comprise a polyolefin polymer.

65. A yarn as recited in claim 51, wherein said cores comprise a copolyamide polymer.

66. A yarn as recited in claim 51, wherein said cores comprise a copolyester polymer.

67. A yarn as recited in claim 51, wherein said matrix comprises a polyamide polymer.

68. A yarn as recited in claim 51, wherein each of said filaments has the same number of cores.

69. A yarn as recited in claim 51, further comprising distribution of said cores on a plurality of concentric circles as seen in any transverse cross sectional view of said filament.

70. In a yarn consisting of a plurality of composite filaments wherein each filament includes at least two different incompatible synthetic linear high polymers, and wherein one polymer functions as a matrix and said other polymer consists of a multiplicity of continuous ultra fine cores distributed substantially uniformly throughout the longitudinal body of the matrix, and wherein each core is characterized by its uniformity in cross sectional dimension, and the cross section dimensions from core to core being of the same order of magnitude, the improvement comprising distribution of said cores on a plurality of substantially concentric circles as seen in any transverse cross sectional view of said filament.

71. A yarn as recited in claim 70, wherein said cores are substantially parallel to one another when said filament is viewed in longitudinal section.

72. A yarn as recited in claim 70, wherein said cores all have substantially the same denier.

73. A yarn as recited in claim 70, wherein the number of said cores in each said filament is less than 10.

74. A yarn as recited in claim 70, wherein the number of said cores in each said filament is 10 to 10,000.

75. A yarn as recited in claim 70, wherein said cores are spaced apart from each other and wherein each said core is completely adjacently enclosed by said matrix.

76. A yarn as recited in claim 70, wherein a plurality of said cores are in contact with other cores and with said matrix.

77. A yarn as recited in claim 70, wherein each said filament is substantially homogenous, and any flexing stress is exerted substantially uniformly throughout the filament regardless of the direction in which the stress is exerted.

78. A yarn as recited in claim 70, wherein the ratio of cores to matrix is at least 11:25.

79. A yarn as recited in claim 70, wherein said cores comprise a polyamide polymer.

80. A yarn as recited in claim 70, wherein said cores comprise a polyester polymer.

81. A yarn as recited in claim 70, wherein said cores comprise a polyacrylic polymer.

82. A yarn as recited in claim 70, wherein said cores comprise a polyurethane polymer.

83. A yarn as recited in claim 70, wherein said cores comprise a polyolefin polymer.

84. A yarn as recited in claim 70, wherein said cores comprise a copolyamide polymer.

85. A yarn as recited in claim 70, wherein said cores comprise a copolyester polymer.

86. A yarn as recited in claim 70, wherein said cores comprise a polyamide polymer.

87. A yarn as recited in claim 70, wherein each of said filaments has the same number of cores.

88. A yarn as recited in claim 70, wherein each said filament is free of irregularly shaped cores at its periphery.

* * * * *

UNITED STATES PATENT AND TRADEMARK OFFICE

CERTIFICATE OF CORRECTION

PATENT NO. : 4,350,006

DATED : September 21,1982

INVENTOR(S) : Okamoto et al

It is certified that error appears in the above-identified patent and that said Letters Patent is hereby corrected as shown below:

Column 1, line 15, "There" should read --These--

Column 2, line 24, "behavier" should read --behavior-- line 62 "combination" should read --combinations--

Column 5, line 43, "mean" should read --means-- line 47, "sheath is" should read --sheath.--

Column 6, line 23, "spining" should read --spinning-- line 25,"differences" should read --different-- lines 46 and 47 "as shown in Fig. 4 polymer blending process" should read --Conventional polymer blending process as shown in Fig. 4.--

Column 7, line 4, "comes " should read --come--

Column 8, line 21, "A passage(222) should read --B passage (221)--

UNITED STATES PATENT AND TRADEMARK OFFICE

CERTIFICATE OF CORRECTION

PATENT NO. : 4,350,006

DATED : September 21,1982

INVENTOR(S) : Okamoto et al

It is certified that error appears in the above-identified patent and that said Letters Patent is hereby corrected as shown below:

line 50, "th" should read --the-- line 62, "flows" should read --flow-- line 65, "dispersed. Further" should read --dispersed further.--

Column 9, line 20, "preferably" should read --preferable-- line 49, "A passage" should read --A passages--;"B passage" should read --B passages-- line 60 "lamimated" should read --Laminated--

Column 10, line 29, "no" should read --an-- line 33, "ca" should read --can-- line 56, "filters porous" should read --filters, porous--

Column 11, line 35, "prepared" should read --prepare-- line 53, "diameter" should read --diameters-- line 58, "th" should read --the--

Column 12, line 34, delete "of"

Column 13, line 1, "microfilaments" should read --monofilaments-- line 10, "measred" should read --measured--

UNITED STATES PATENT AND TRADEMARK OFFICE

CERTIFICATE OF CORRECTION

PATENT NO. : 4,350,006

DATED : September 21,1982

INVENTOR(S) : Okamoto et al

It is certified that error appears in the above-identified patent and that said Letters Patent is hereby corrected as shown below:

line 13, "in" should read --is--

Column 14, line 14,"the brilliancy" should read --the brilliant-- line 16, delete "having a brilliancy"

line 43, "spin" should read --spun-- line 52, "filamens" should read --filaments--

Column 17, line 34, "cores substantially" should read --cores are substantially--

Column 18, line 16, "polyer" should read --polymer-- line 50, "polyamide" should read --polyester--.

Signed and Sealed this

Twenty-fourth Day of May 1983

[SEAL]

Attest:

DONALD J. QUIGG

Attesting Officer

Acting Commissioner of Patents and Trademarks